US010286573B2

(12) United States Patent
Cunningham et al.

(10) Patent No.: US 10,286,573 B2
(45) Date of Patent: May 14, 2019

(54) MIXING PLANT AND RELATED PRODUCTION METHODS

(71) Applicants: Carl Cunningham, Las Vegas, NV (US); Richard Thornton, Las Vegas, NV (US); Craig Lawson, Fullerton, CA (US)

(72) Inventors: Carl Cunningham, Las Vegas, NV (US); Richard Thornton, Las Vegas, NV (US); Craig Lawson, Fullerton, CA (US)

( * ) Notice: Subject to any disclaimer, the term of this patent is extended or adjusted under 35 U.S.C. 154(b) by 305 days.

(21) Appl. No.: 15/216,532

(22) Filed: Jul. 21, 2016

(65) Prior Publication Data

US 2017/0021529 A1 Jan. 26, 2017

Related U.S. Application Data

(60) Provisional application No. 62/195,247, filed on Jul. 21, 2015.

(51) Int. Cl.
*B28C 7/02* (2006.01)
*B01F 15/02* (2006.01)
(Continued)

(52) U.S. Cl.
CPC ..... *B28C 7/02* (2013.01); *B01F 7/085* (2013.01); *B01F 13/0037* (2013.01);
(Continued)

(58) Field of Classification Search
CPC ..... B28C 7/02; B28C 7/044; B28C 9/0463; B01F 7/085; B01F 13/0037;
(Continued)

(56) References Cited

U.S. PATENT DOCUMENTS 831,658 A 9/1906 Ericsson
935,782 A 10/1909 Demorest
(Continued)

FOREIGN PATENT DOCUMENTS

CN 201275804 Y 7/2009
EP 0816032 7/1998
WO WOCA9623639 8/1996

OTHER PUBLICATIONS

Trailer Dimensions—AAA Digenst of Motor Laws, https://drivinglaws.aaa.com/tag/tailer-dimensions/, accessed Jul. 18, 2018.*

*Primary Examiner* — Marc C Howell
(74) *Attorney, Agent, or Firm* — Weide & Miller, Ltd.

(57) ABSTRACT

A mobile construction plant includes two sets of low-profile bins: one set containing granular materials and the other set containing powdery materials. Each of the bins is mounted on a weighing mechanism that pre-weighs the contents before mixing. An elongated dual shaft mixer having a small bore diameter is located below the bins. A set of belt conveyors is provided for transporting materials from the granular material bins to the mixer, and a blending auger is provided for transporting materials from the powdered material bins to the mixer. All of the bins, the conveyors, the blending auger, the mixer, and other components are supported on a small footprint frame that can easily be transported to a job site.

18 Claims, 11 Drawing Sheets

(51) Int. Cl.

| | |
|---|---|
| ***B01F 7/08*** | (2006.01) |
| ***B01F 15/00*** | (2006.01) |
| ***B01F 13/00*** | (2006.01) |
| ***B28C 7/04*** | (2006.01) |
| ***B28C 9/04*** | (2006.01) |

(52) U.S. Cl.
CPC .... *B01F 15/00194* (2013.01); *B01F 15/0229* (2013.01); *B01F 15/0267* (2013.01); *B28C 7/044* (2013.01); *B28C 9/0463* (2013.01); *B01F 2215/0047* (2013.01)

(58) Field of Classification Search
CPC ..... B01F 15/00194; B01F 15/0229; B01F 15/0267; B02F 15/00194; B02F 15/0229; B02F 15/0267
USPC ..... 366/8
See application file for complete search history.

(56) References Cited

U.S. PATENT DOCUMENTS

| | | | | | |
|---|---|---|---|---|---|
| 1,823,343 | A | | 9/1931 | Billner | |
| 2,284,975 | A | | 6/1942 | Horner | |
| 2,800,312 | A | | 7/1957 | Ruby | |
| 2,873,036 | A | | 2/1959 | Noble | |
| 3,090,501 | A | | 5/1963 | Auld | |
| 3,198,494 | A | | 8/1965 | Curran | |
| 3,215,408 | A | | 11/1965 | Hansen | |
| 3,343,688 | A | | 9/1967 | Ross | |
| 3,363,806 | A | | 1/1968 | Blakeslee | |
| 3,424,438 | A | | 1/1969 | Knotts | |
| 3,448,866 | A | | 6/1969 | Perry | |
| 3,667,736 | A | | 6/1972 | Carroll | |
| 3,746,313 | A | | 7/1973 | Weeks | |
| 3,871,628 | A | | 3/1975 | Pulk | |
| 3,872,980 | A | | 3/1975 | Hagan | |
| 3,998,436 | A | | 12/1976 | Allen | |
| 4,178,117 | A | | 12/1979 | Brugler | |
| 4,285,598 | A | | 8/1981 | Horton | |
| 4,298,288 | A | | 11/1981 | Weisbrod | |
| 4,304,493 | A | * | 12/1981 | Frankie | B01F 13/1002 222/135 |
| 4,345,858 | A | | 8/1982 | Barlow | |
| 4,406,548 | A | | 9/1983 | Haws | |
| 4,556,323 | A | | 12/1985 | Elkin | |
| 4,579,459 | A | | 4/1986 | Zimmerman | |
| 4,579,496 | A | | 4/1986 | Gerlach | |
| 4,619,531 | A | | 10/1986 | Dunstan | |
| 4,752,134 | A | | 6/1988 | Milek | |
| 4,783,171 | A | | 11/1988 | Zimmerman | |
| 4,792,234 | A | | 12/1988 | Doherty | |
| 4,854,711 | A | | 8/1989 | Hagan | |
| 4,992,463 | A | | 2/1991 | Tjoeng et al. | |
| D322,973 | S | | 1/1992 | St. Ama | |
| D324,688 | S | | 3/1992 | St. Ama | |
| 5,171,121 | A | | 12/1992 | Smith | |
| 5,240,324 | A | * | 8/1993 | Phillips | B01F 5/265 366/132 |
| 5,277,489 | A | | 1/1994 | Hamm | |
| 5,354,127 | A | | 10/1994 | Del Zotto | |
| 5,411,329 | A | | 5/1995 | Perry | |
| 5,452,954 | A | * | 9/1995 | Handke | B28C 7/02 137/4 |
| 5,634,716 | A | | 6/1997 | Westall | |
| 5,667,298 | A | | 9/1997 | Musil | |
| 5,709,466 | A | | 1/1998 | Weszely | |
| 5,730,523 | A | * | 3/1998 | Flood | B28C 7/02 366/18 |
| 5,785,421 | A | | 7/1998 | Milek | |
| 5,873,653 | A | | 2/1999 | Paetzold | |
| 6,036,353 | A | * | 3/2000 | Paetzold | B01F 15/0425 366/8 |
| 6,106,211 | A | | 8/2000 | Westwood | |
| 6,186,654 | B1 | | 2/2001 | Gunteret, Jr. | |
| 6,244,575 | B1 | | 6/2001 | Vaartstra | |
| 6,293,689 | B1 | | 9/2001 | Guntert, Jr. | |
| 6,439,436 | B2 | | 8/2002 | Epp | |
| 6,474,926 | B2 | | 11/2002 | Weiss | |
| 6,527,428 | B2 | | 3/2003 | Guntert, Jr. | |
| 7,175,333 | B2 | | 2/2007 | Reyneveld | |
| 7,320,539 | B2 | | 1/2008 | Christenson | |
| 7,351,025 | B2 | | 4/2008 | Galijan | |
| 7,645,064 | B2 | | 1/2010 | Cestti | |
| 7,766,537 | B2 | | 8/2010 | Gembala | |
| 8,710,135 | B2 | | 4/2014 | Bower | |
| 2002/0141851 | A1 | | 10/2002 | Weiss | |
| 2003/0142579 | A1 | | 7/2003 | Throop | |
| 2004/0202514 | A1 | | 10/2004 | Endo | |
| 2005/0219939 | A1 | | 10/2005 | Christenson | |
| 2007/0257392 | A1 | | 11/2007 | Etherton | |
| 2008/0273415 | A1 | * | 11/2008 | Thornton | B28C 5/468 366/3 |
| 2009/0177313 | A1 | | 7/2009 | Heller | |
| 2009/0180348 | A1 | | 7/2009 | Long, Jr. | |
| 2014/0216302 | A1 | * | 8/2014 | Ober | B28C 7/0422 106/638 |
| 2014/0355372 | A1 | * | 12/2014 | Black | B01F 7/00216 366/8 |

* cited by examiner

MIXING PLANT AND RELATED PRODUCTION METHODS

CROSS-REFERENCE TO RELATED APPLICATIONS

This application claims the benefit of U.S. provisional application Ser. No. 62/195,247, filed Jul. 21, 2015 the disclosure of which is hereby incorporated in its entirety by reference herein.

TECHNICAL FIELD

The present disclosure relates to mixing plants, and in particular mobile mixing plants for forming concrete and concrete-like materials in batches.

BACKGROUND

Greatly valued for its durability, high compressive strength, and fire-resistance, concrete is one of the world's oldest and most used man-made building materials. In its simplest form, it consists of three main components: aggregates such as sand, gravel and crushed stone; a binder such as Portland cement; and water. Once these components have been mixed, the concrete must be quickly delivered to its intended location, before it hardens and becomes impossible to pour.

Because concrete production is time-sensitive, various methods and devices have been developed over the years for producing and transporting concrete to its ultimate destination in a quick and efficient manner. Central mixing, or wet-batch, concrete production is a method in which all of the ingredients are weighed and mixed in a stationary plant before being discharged to a truck that transports the wet concrete mixture to the construction site. Transit mixing is a method in which all the dry ingredients are weighed at the stationary plant and then charged into a truck that mixes the ingredients as they are being transported to the construction site, where water is added. In shrink mixing, mortar ingredients (sand, cement, water, and admixtures) are added, and the coarse aggregates are added as the mortar is discharged to the truck. All of these methods have certain advantages and disadvantages. Central mixing is generally recognized as allowing better quality control and faster production, but is not practical for all construction sites. The complexity of the plant makes portable set up more costly and time consuming. Transit mixing plants are generally less complex and less costly to operate, but standard transit mix plants do not have a concrete mixer, removing some of the advantages of the product quality control. Shrink mixing plants retain the product control that central mix gives, and allow the batch size to be increased and the mixing time to be decreased. By performing the final mixing in the revolving drum mixer truck or other transport unit, the plants allow for potentially higher production rates.

Some attempts have been made to design mobile mixing plants that allow concrete to be mixed and poured at the construction site. However, most of these plants have required a large number of individual components, such as bins and mixers, which are typically transported on separate trucks and assembled together at the site. The time and labor involved in transporting and installing these plants can be prohibitive. The volumetric trucks that are capable of mixing concrete in one complete unit do not provide concrete quality control required for all structural applications.

Another problem associated with modern-day concrete production is that Portland cement is produced in large, fossil fuel-burning kilns that create air pollution and emit large amounts of carbon, contributing significantly to global warming. As a result, various alternative binders such as environmentally friendly geo-polymer cements are growing in popularity. These cements require the use of activators and various other additives that require the use of additional bins and tanks. Current cement trucks and mobile mixing plants are not configured to accommodate these extra containers.

The above problems and other problems are addressed by this disclosure as summarized below.

SUMMARY

The present disclosure relates to a construction plant including a plurality of bins adapted to hold construction materials, a horizontal shaft mixer configured to receive and mix materials discharged from bins, and conveying mechanisms for transporting the materials from the bins to the mixer. The bins, mixer, and conveying mechanisms are supported on a frame that keeps the components together as a compact unit for convenient transportation. A plurality of lift legs attached to the frame to allow the construction plant to be set at a job site. In some embodiments, plant has a maximum dimension of no more than 53 feet in length, 13 foot 6 inches in height, and 8 foot 6 inches in width. In one embodiment, the length of the plant is less than 40 feet.

In one embodiment, the frame includes a plurality of wheels and is provided with a fifth wheel hitch, allowing the construction plant to be attached to a motorized vehicle for towing. In another embodiment, the wheels and trailer fifth wheel hitch may be eliminated, and the frame may be transported or mounted on a flatbed truck.

The plurality of bins includes a first set of low-profile bins configured to contain and dispense granular materials, and a second set of low-profile bins configured to contain and dispense powdery materials. In some embodiments, the granular materials may be aggregates and the powdery materials may be cementitious materials. Each bin may be provided with a scale configured to measure the weight of the material contained in the bin. Tanks containing liquids such as water, cement activators, and cement admixtures may also be supported on the frame.

The conveying mechanisms include a first conveying assembly for transporting granular materials from the first set of bins to the mixer and a second conveying assembly for transporting powdery materials from the second set of bins to the mixer. In some embodiments, the first conveying assembly may include a plurality of belt conveyors, wherein each conveyor is associated with and located below a different one of the bins in the first set. In some embodiments, the second conveying assembly may include a blending auger that receives and combines the powdered materials from the bins in the second set before delivering them to the mixer. The second conveying assembly may also include an internal auger at the bottom of each of the bins in the second set, for facilitating discharge of powdery materials from these bins.

In some embodiments, the first set of bins is located at the distal end of the plant, directly above the distal end of the mixer, which communicates with a discharge auger. One or more of the bins in this set may contain a vibrating mechanism for facilitating discharge of granular materials from the bin. The bin nearest the discharge auger contains coarse aggregates. The conveyor underneath this bin is a two-way conveyor, allowing the coarse aggregates to be transported either to an interior portion of the mixer, for central or transit mixing, or to a shrink mixing inlet at the discharge end of the mixer, where it combines with the mortar before discharge.

In some embodiments, the mixer includes a mixer mechanism mounted for rotation within a mixer housing. The mixer mechanism may be a reversible, twin-shaft mixer. The mixer housing may have a plurality of granular material inlets, including a shrink mixing inlet, central and transit mixing inlets, and a single cementitious inlet. The shrink mixing inlet may be located at the distal end of the mixer, below the distal end of the coarse aggregate conveyor. A first central and transit mixing inlet is located proximally of the shrink mixing inlet, below the proximal end of the coarse aggregate conveyors, and at least one other central transit mixing inlet is located proximally of the first central and transit mixing inlet, below a conveyor associated with at least one of the other granular material bins.

In some embodiments, a controller is electronically coupled weight scales, and configured operating the mixer, the conveyor mechanisms, and the discharge auger in response to information received from the weight scales. Both the controller and the mixer may be powered by a hydraulic power system comprising a diesel engine and a battery. Alternatively, the controller, mixer, and other components may be powered by electrical power and motors, or by alternative energy sources, such as solar energy, wind, and the like.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

For the purposes of this example, the invention will be described as a concrete plant, and will use terms, such as "cement" and "aggregate", which are common in the concrete industry. However, a wide variety of products other than concrete may be produced in this plant, such as landscaping materials, USGA root zone mixes, and other products requiring a blend of granular and powdery materials. Thus, the term "cement" should be understood to include to any cement-like or cementitious product or binder or, more broadly, any powdery substances having a mesh size of smaller than 200 mesh. Similar, the term "aggregate" refers to sand, gravel, crushed stone, and similar granular products having a mesh size of 200 or greater.

Figure 1A:
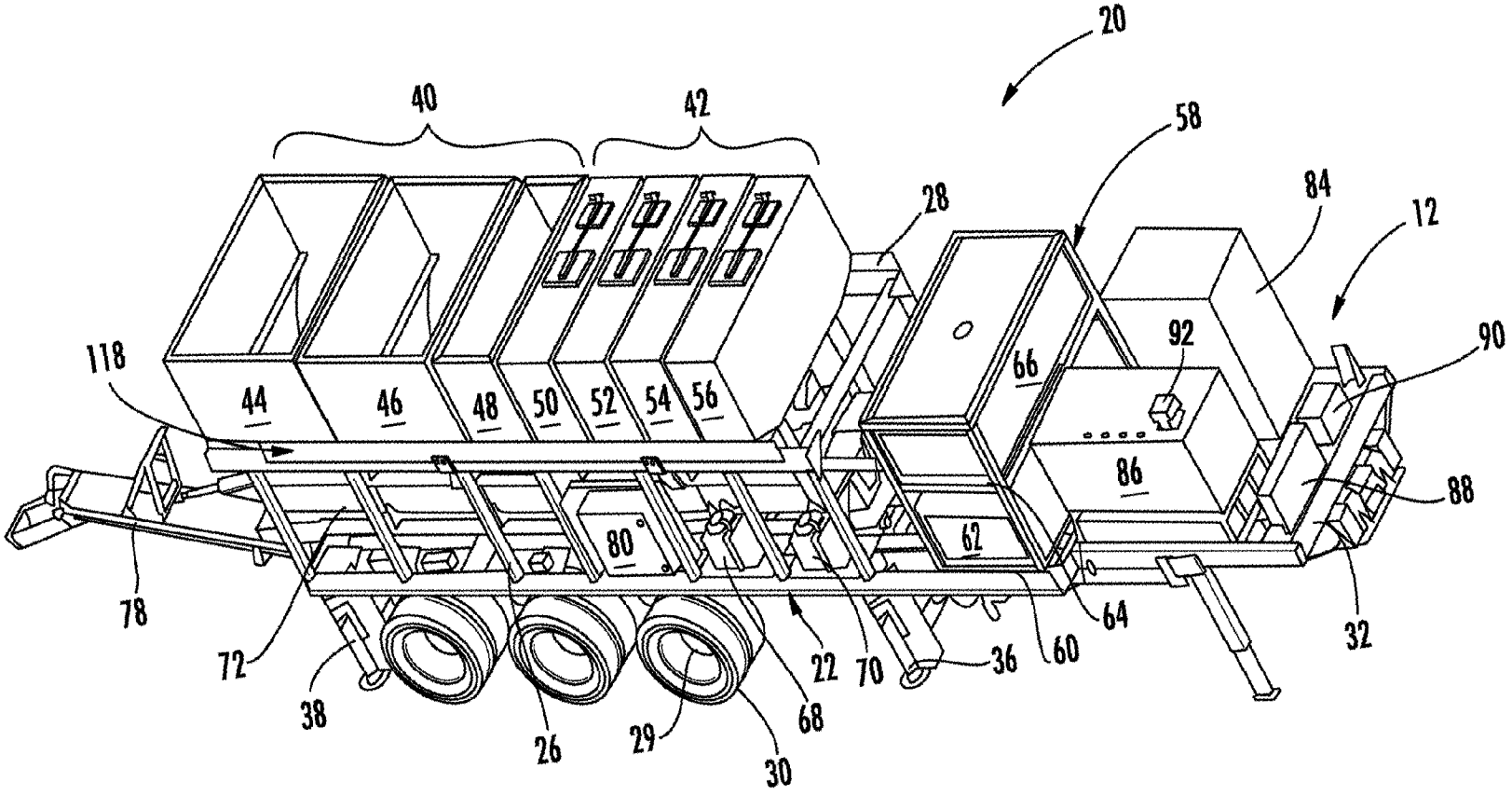
FIG. 1A is a perspective view, taken from the right, of a towable embodiment of a mixing plant of the present disclosure.
Figure 1B:
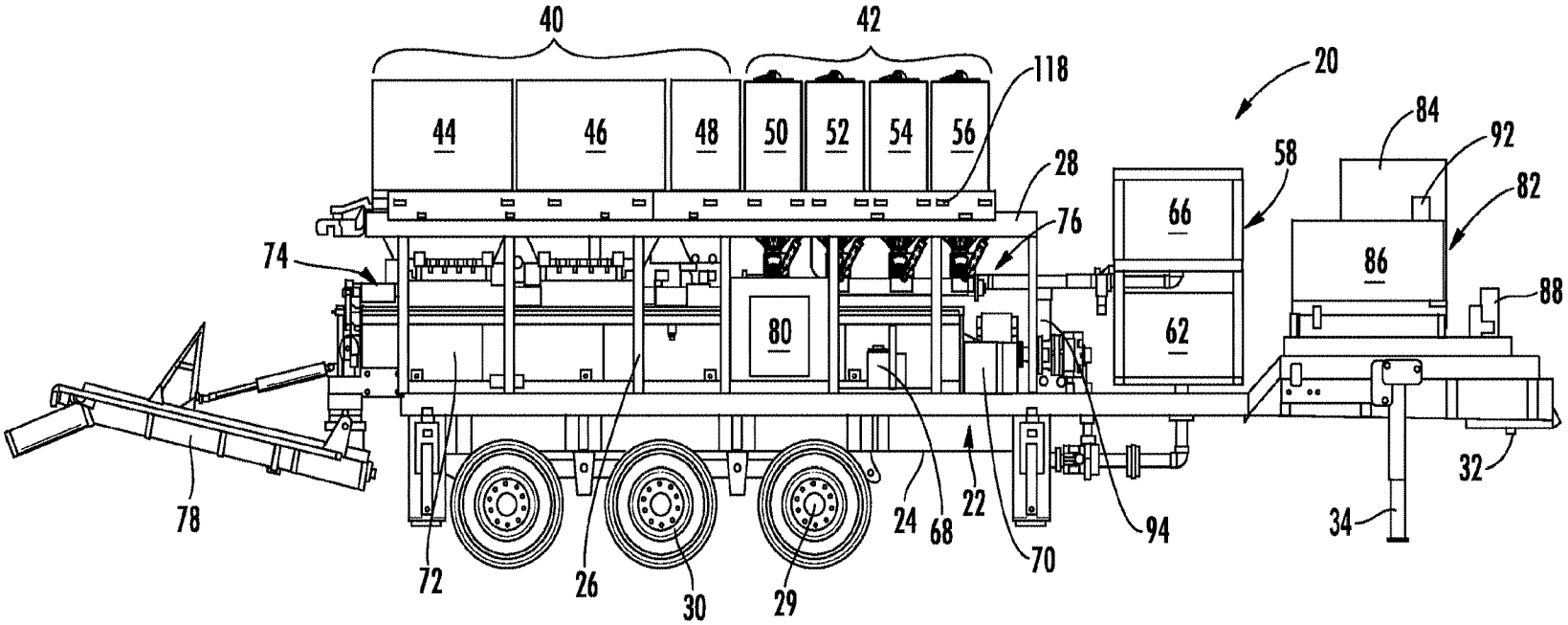
FIG. 1B is a right side elevation view of the mixing plant of FIG. 1A.

Referring to FIGS. 1A and B, the mixing plant 20 according to one embodiment of the present disclosure includes a frame 22 having a flat base 24 with a plurality of vertically extending posts 26 provided along opposite sides. The posts 26 support a pair of horizontally extending rails 28, upon which a plurality of bins, which may also be called scales, are mounted. A plurality of axles 29 and wheels 30 are provided on the underside of the frame 22, and a fifth wheel hitch 32 is attached to the front of the frame 22, allowing the plant 20 to easily be towed by a motorized vehicle. In addition, a plurality of pivotable and extensible legs 34, 36, 38 is provided to support and position the mixing plant 20 at a construction site.

The bins supported on the rails 28 include a first set of bins 40 for containing granular materials such as aggregates and a second set of bins 42 for containing powdery materials such as cement and other binders. The first set of bins 40 is located at the distal end of the rails 28, and the second set of bins 42 is located at the proximal end of the rails 28. The first set of bins 40 includes a distalmost granular material bin 44, which may contain a coarser material than the other granular material bins 46, 48. For example, the distalmost granular material bin 44 may contain coarse aggregates, such as gravel or crushed stone for producing concrete. Bins 42, 46, and 48 may be substantially identical to one another in structure, and may be equal to one another in height and width, but may differ in length. For instance, the proximalmost granular material bin 48 may be shorter in length than bins 42 and 48, for containing materials that are required in smaller volumes. The powdered material bins 50, 52, 54, and 56 in the second set of bins 42 may also be the same height and width as the granular material bins 40 and in the illustrated embodiment are equal in the length to one another, but this is not required.

A rack 58 is supported on the base 24 of frame 22 proximally of the first and second sets of bins 40, 42. The rack 58 includes a lower shelf 60 supporting a first tank 62 for containing a first liquid such as water, and an upper shelf 64 supporting a second tank 66 for containing a second liquid such as cement activator. In addition, a pair of admixture tanks 68, 70 is supported on the base 24 of frame 22 between the liquid tanks 62, 66 and the bins 44-56.

A horizontal shaft mixer 72 is supported on the base 24 of the frame 22, below the bins 44-56. A first conveyor assembly 74 between the granular material bins 44-48 and the mixer 72 is provided for delivering granular materials from the bins 44-48 to the mixer 72. A second conveyor assembly 76 between the powdery material bins 50-56 and the mixer 72 is provided for providing powdery materials from the bins 50-56 to the mixer 72. In addition, a discharge auger 78 is provided for discharging the final mixture to a concrete form, a truck, or other location.

A batch controller 80 mounted on one side of the frame 22 includes a computer or other logic based technology for monitoring the materials in the various bins and tanks and operating the mixer 72, conveying assemblies 74, 76, discharge auger 78, and other components of the plant 20 as needed. Various commercially available programmable batch controllers may be suitable for use with the disclosed system. The Jonel Archer batch controller (Fullerton, Calif.) is one example of such a controller.

The batch controller 80 may receive information from a variety of sources. For instance, it may receive concrete quality information from concrete sensors located inside the mixer 72. It also receives weight information from load cells located under each of the bins and tanks containing construction materials. The controller 80 processes this information to determine parameters such as the proper opening and closing times, durations, and sequence for the valves associated with the various bins and tanks. More specifically, the batch controller 80 controls the operation of the various rams, valves, conveyors, and other components of the system as needed to batch the material mixtures.

In one operation, the batch controller 80 monitors the weight of materials entering or exiting the various bins and tanks, and cuts off flow when predetermined conditions are met. The controller 80 then waits for 2 seconds as required by NIST Handbook 44 before accepting the weight. If at this point, the materials are under the required weight, the materials are "jogged" until the weight is within accepted tolerances. If the materials are overweight, the controller 80 flags the operator to accept or reject the load.

The batch controller 80 may also ensure quality levels by determining, for instance that the discharge valves will not be opened unless and until certain quality requirements are met. In addition, the batch controller 80 may also be programmed to allow an operator to select a particular type of batch mixing operation to be performed. For instance, an operator may be allowed to select from such methods and approaches as truck-mixed, shrink-mixed, central-mixed batching processes, among others.

The controller 80, mixer 72, conveying assemblies 74, 76, discharge auger 78, and other components are powered by a power system 82. In the illustrated embodiment, the power system 82 is a hydraulic power system including a diesel engine 84, hydraulic pumps, diesel fuel tank, oil tank 86, oil cooler 88, battery 90, low pressure filter 92, and high pressure filter 94. In other embodiments, the power system may be electric or solar.

In one embodiment of the invention, the frame 12, bins, 44-56, tanks 62, 66, 68, 70, mixer 72, conveying assemblies 74, 76, controller 80, and power system 82 are all sized and configured such that the maximum dimensions of the plant are no more than 53 feet in length, 13 foot 6 inches in height, and 8 foot 6 inches in width. In one embodiment, the length of the plant is no more than 40 feet in length. This small footprint allows the plant to be towed on public roads without a special permit. In addition, it reduces the amount of time required to set up the plant, and allows for use in job sites with limited working space. In addition, the short height makes it convenient to fill the bins with equipment that is not as large as required for other plant setups. The bins may be refilled with super sacks of product on jobs that do not require high production rates. This eliminates the need for stockpiles of materials for replenishment.

Figure 2:
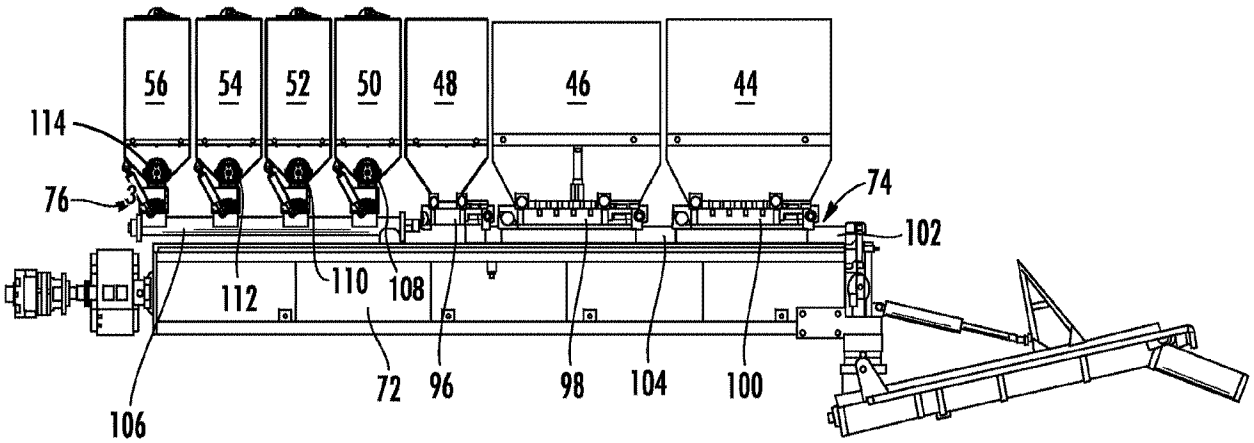
FIG. 2 is a left side elevation view showing the bins, mixer, and discharge auger of the mixing plant of FIGS. 1A and B.

FIG. 2 shows the relationship between the first set of bins 40, the second set of bins 42, the first conveyor assembly 74, the second conveying assembly 76, the mixer 72, and the discharge auger 78. The first conveyor assembly 74 includes a set of conveyors 96, 98, 100, with each conveyor being located below a different one of the granular material bins 44-48. The conveyors 96, 98, 100 may be belt conveyors or any similar low profile device capable of moving granular materials from the outlet of one of the bins 44-48 to an inlet of the mixer 72. They may also simply be discharge valves allowing gravity feed into the mixer 72. The conveyor 100 beneath the distalmost granular material bin 44 is a two-way conveyor, allowing coarse aggregate exiting the bin 56 to be moved either distally, towards a shrink mixing inlet 102 located at the distal end of the mixer 72, or proximally, towards a central and transit mixing inlet 104 located in an intermediate portion of the mixer 72. The second conveyor assembly 76 includes a blending auger 106 located below the powdery material bins 50-56. In addition, the second conveyor assembly 76 includes a set of internal augers 108, 110, 112, 114, with each internal auger being located within the bottom end of a different one of the bins 50-56.

Figure 11:
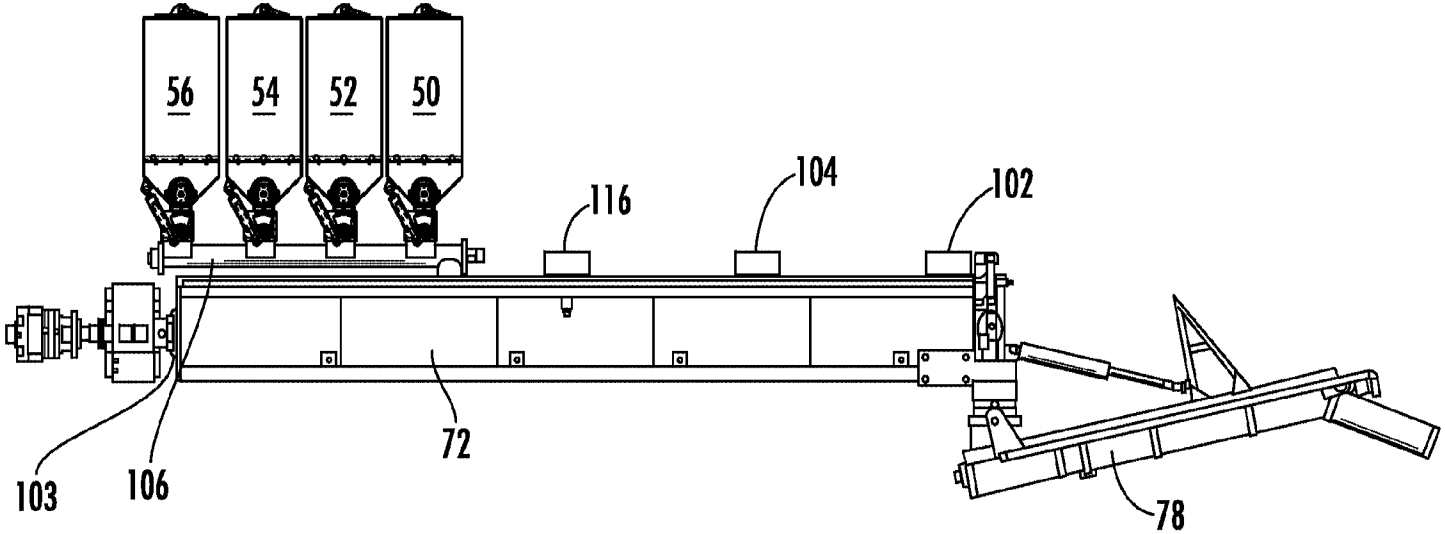
FIG. 11 is a left side elevation view similar to FIG. 2, but with the aggregate bins removed.

FIG. 11 is similar to FIG. 2, with the first set of bins 40 removed to better show the granular material inlets 102, 104, 116, associated with the bins of that set. The shrink mixing inlet 102 is located at the distal end 103 of the mixer 72 so that coarse aggregate entering it need not pass through the complete mixer 72, but may instead be instead pass through only the mixer gates and into the discharge auger 78. The first central and transit mixing inlet 104 is located in an intermediate portion of the mixer 72, between the longitudinal center and the distal end 103, and the second transit and central mixing inlet 116 is located at or near the longitudinal center of the mixer 72. Referring back to FIG. 2, first central and transit mixing inlet 104 receives materials from granular material bin 46, which may contain small aggregate material such as sand, and second central and transit mixing inlet 116 receives materials from granular material bin 48, which may contain a different small aggregate material from that contained in granular material bin 46.

Figure 4A:
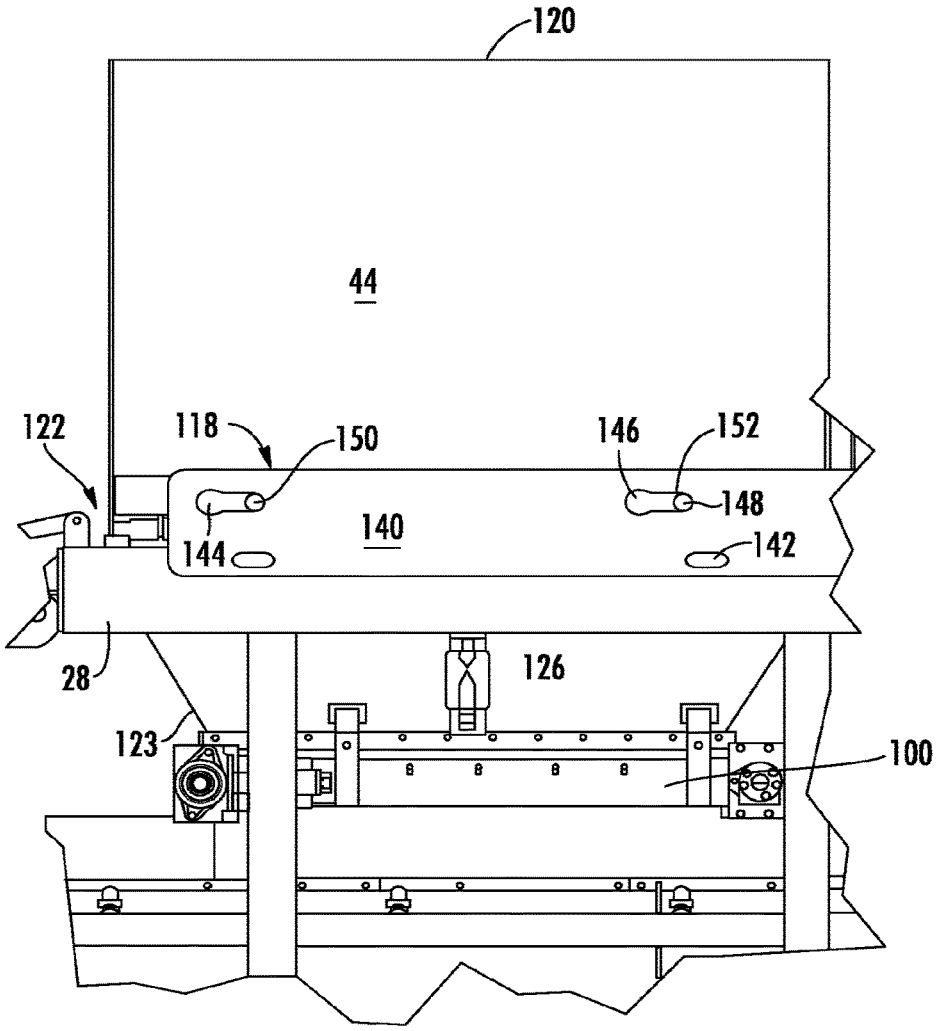
FIG. 4A is a fragmentary right side elevation view showing a coarse aggregate bin according to an embodiment of the present disclosure.
Figure 4B:
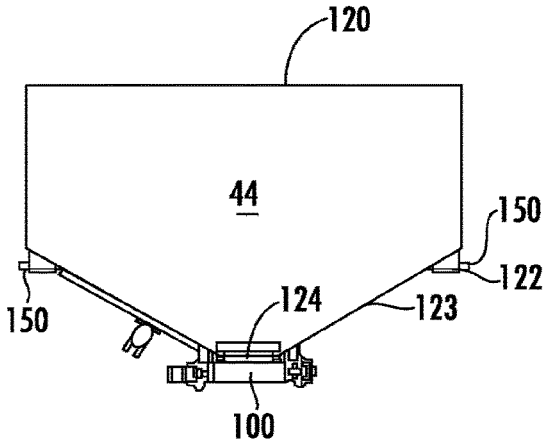
FIG. 4B is a front elevation of the bin of FIG. 4A.

FIGS. 4A and B show the coarse aggregate bin 44 which, along with the other bins 46-56, is held in place on rail 28 by a hold-down mechanism 118. The top end 120 of the bin 44 is open to allow the entry of moisture-conditioned aggregate quickly without dust being created. The bottom end includes a lower corner portion 122 that communicates with a tapered discharge portion 123 terminating in a selectively openable discharge port 124 that dispenses coarse aggregate onto two-way belt conveyor 100. The bin 44 is a low-profile bin, meaning that the length of the tapered portion 123 has been reduced relative to conventional bins, in order to minimize the height of the bin, while maximizing the storage capacity and allowing the contents of the bin to be at least about 95 to 100% discharged. In other words, the bin has a greater storage capacity than a conventional bin of the same height or, alternatively, is shorter than a conventional bin having the same storage capacity, while still allowing its contents to be at least about 95% to 100% discharged. A vibration mechanism 126 may be provided on the bottom end 122 to facilitate complete emptying of the bin 44.

Figure 3:
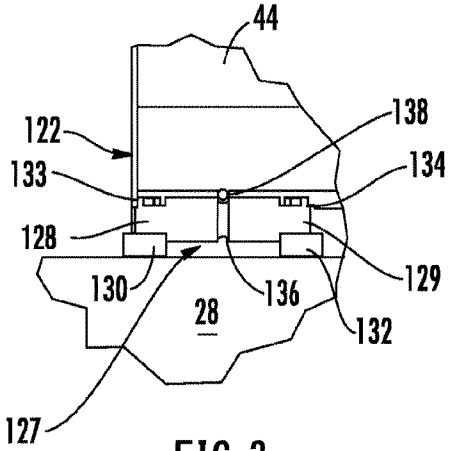
FIG. 3 is a right side view of a load cell of one of the bins of the mixing plant.

At least one load cell 127 is provided underneath the lower corner portion 122 of the bin 44, in a space between the bin 44 and the rail 28. The number of load cells under each bin is determined by Handbook 44. As seen in FIG. 3, each load cell 127 is substantially cylindrical and includes a pair of opposite flange portions 128, 129 which are secured to tabs 130, 132 on the rail 28 by bolts 133, 134. In addition, a circumferentially extending groove 136 in the center of the load cell 127 receives an alignment pin 138 that extends downwardly from the lower corner portion 122 of the bin 44.

The small aggregate bins 46 and 48 may be substantially identical in structure to the coarse aggegrate bin 44, except that their respective conveyors 96, 98 need not be two-way conveyors.

Returning now to FIG. 4A, the hold-down mechanism 118 includes an elongated bar 140 extending along each rail 28 of frame 22. A series of elongated slots 142 is provided along the bottom edge of each bar 128, and a series of generally pear-shaped slots 144 is provided along the top edge of each bar 128. The elongated slots 142 receive pins, bolts, or other projecting members extending from or into the rails 28, thus securing the bars 140 to the rails 28, while allowing a very small amount of lateral sliding movement. The pear-shaped slots 144, each of which has an enlarged distal end 146 and a reduced proximal end 148, receive pins 150, 152 that extend laterally from opposite sides of the lower corner portion 122 of the bin. During transit, each pin 150, 152 is retained in the reduced proximal end 148 of its associated pear-shaped slot 144, thus preventing the bin 44 from lifting off the load cell 127. Upon arrival at a job site, a manually operated lever or other controller is actuated, causing associated rams to move the bar 140 proximally, so that the pins 150, 152 are no longer retained in the reduced proximal ends of the pear-shaped slots 144 but instead held in the enlarged distal ends 146 of the slots 144, allowing the bin 44 to contact the load cell 127 so that weight measurement may begin.

Figure 5:
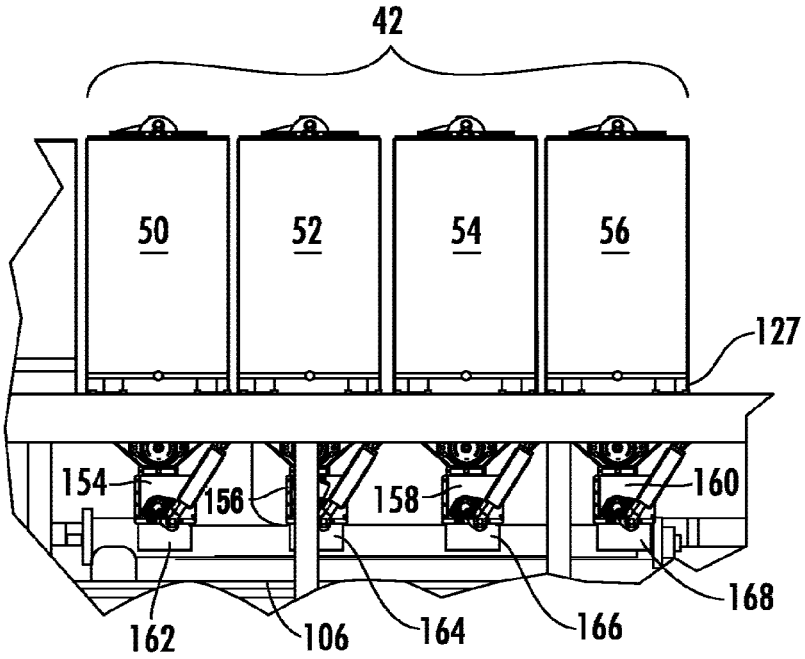
FIG. 5 is a right side elevation of a set of cementitious bins according to an embodiment of the disclosure, with the hold-down mechanism removed to show the load cells.

FIG. 5 shows the second set of bins 42 in relationship to the blending auger 106. The hold-down mechanism 118 has been removed to show the load cells 127 located at the corners of each bin 50, 52, 54, 56. Discharge from the powdery material bins 50, 52, 54, 56 is controlled by gate valves 154, 156, 158, 160 coupled to the bins 50, 52, 54, 56. When opened, each of the gate valves 154, 156, 158, 160 allows powdery material to flow into the blending auger 106 through an associated inlet opening 162, 164, 166, 168.

Figure 6A:
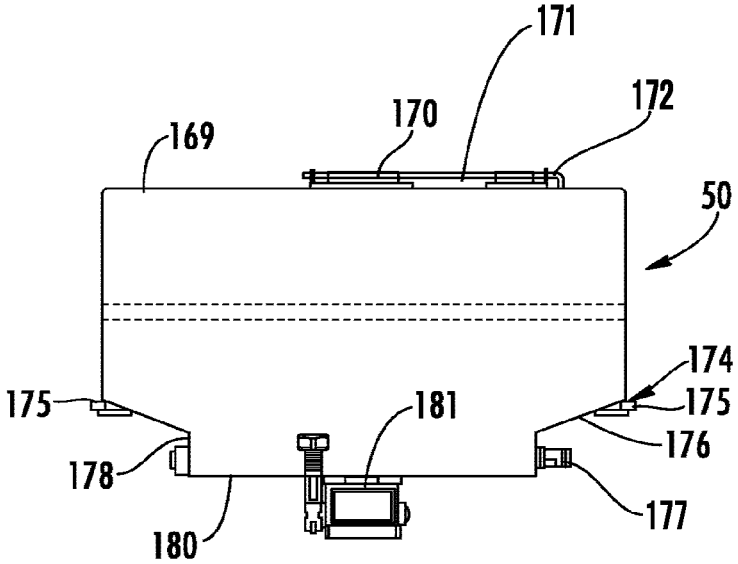
FIG. 6A is a cross-section view of one of the bins showing the internal components of one of the bins of FIG. 5.
Figure 6B:
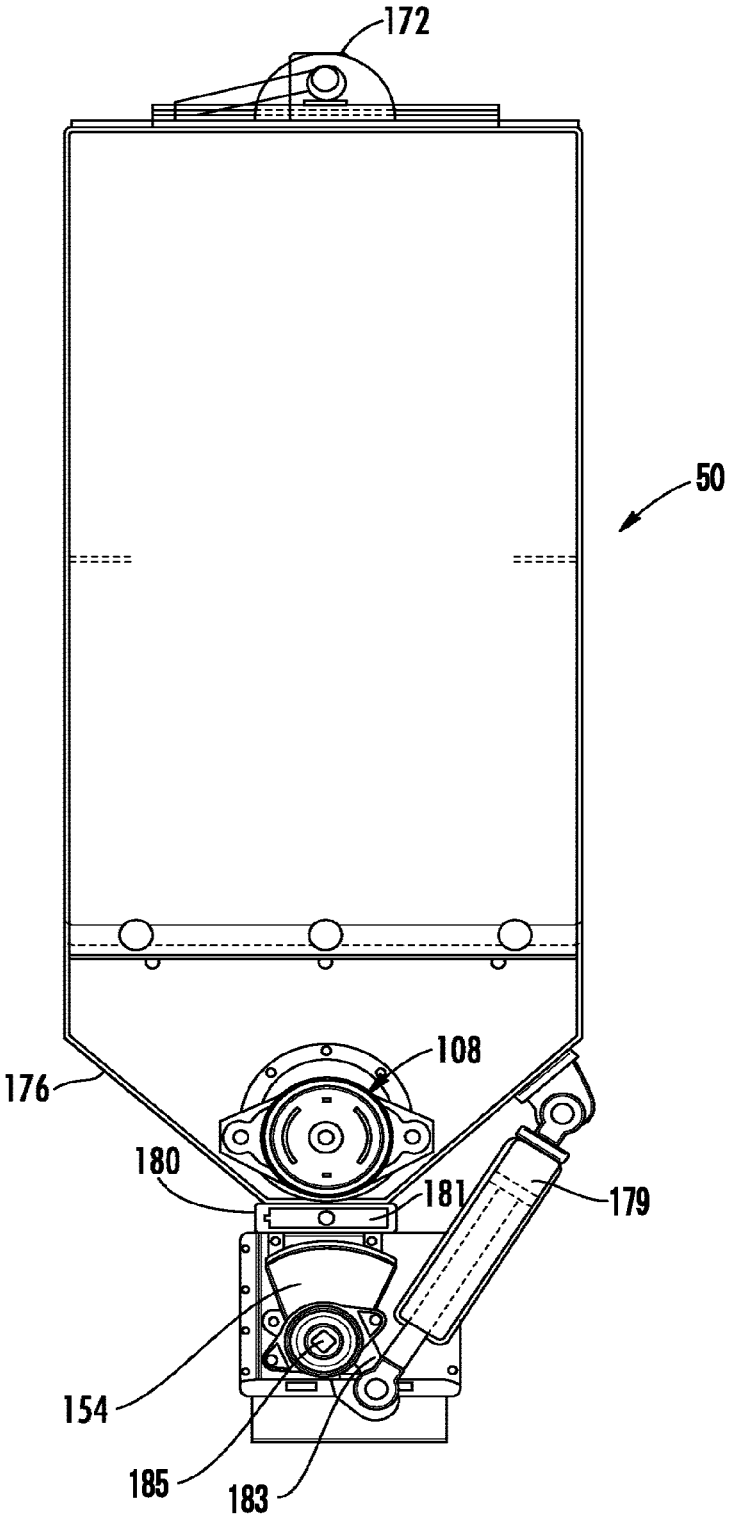
FIG. 6B is a right side elevation view of the bin of FIG. 6A.

FIGS. 6A and B show powdery material bin 50, which is substantially identical to the other powdery material bins 52, 54, 56, in the second set 42. Like the bins in the first set 40, powdery material bin 50 has a low profile. However, unlike the bins in the first set 40, the powdery material bin 50 has a closed upper end 169 including a large access hatch 170 and a small access hatch 171. The large access hatch 170 is configured to receive powdery materials from an outside source, while the small hatch 171 is configured to allow a dust control device to access the interior of the bin 50. A hatch securing mechanism 172 is provided for holding the hatches 170, 171 in a closed position.

The bin 50 has a lower corner portion 174 having a set of laterally projecting pins or bolts 175 that are received in the associated pear-shaped slots 144 in the hold-down mechanism 118. The lower corner portion 174 communicates with a very short tapered portion 176 that, in some embodiments, may be eliminated altogether. The tapered portion 176 terminates in a wide cylindrical neck 178 having a flat bottom 180 that defines a discharge opening 181. Internal auger 108, located just above the flat bottom 180 and driven by hydraulic motor 177 facilitates the flow of powdery material through the discharge opening 181. Below the blending auger 108 is a gate ram 179 which, when actuated by the controller 80, pushes against arm 183 causing shaft 185 to rotate 90°, opening the gate valve 154 to allow materials to be discharged.

Figure 7A:
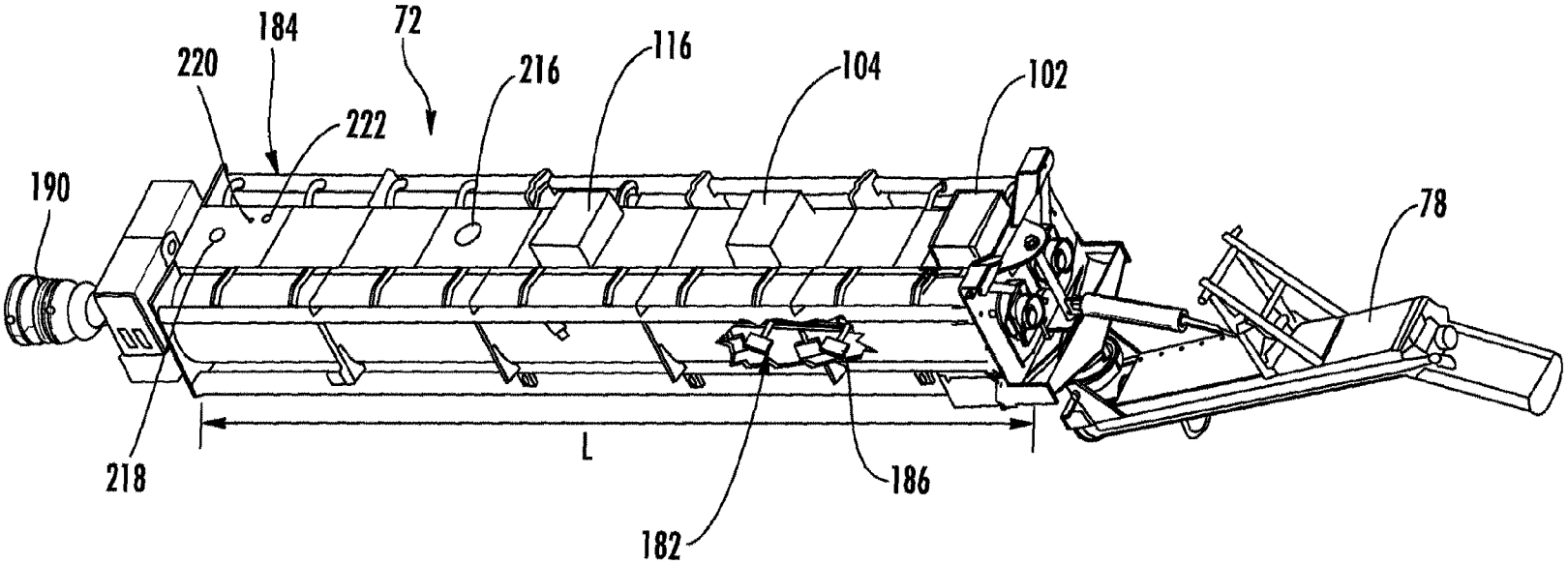
FIG. 7A is a right side isometric view of a mixer of the mixing plant, with a portion broken away to show the interior.
Figure 7B:
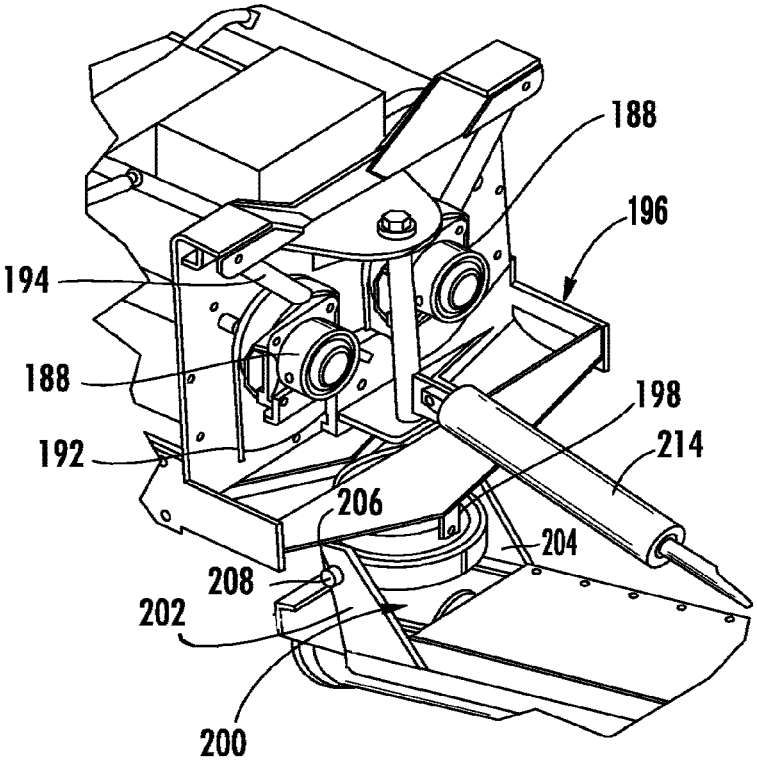
FIG. 7B is a front isometric view of the mixer of FIG. 7A.
Figure 7C:
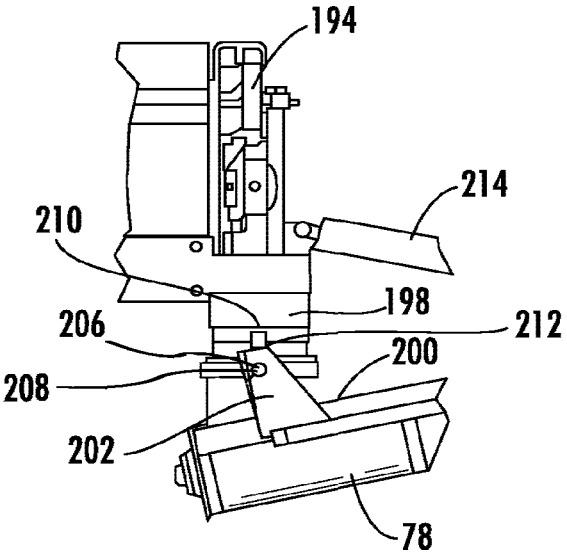
FIG. 7C is a right side elevation of FIG. 7B.

As seen in FIGS. 7A-C the mixer 72 includes a mixing mechanism 182 mounted for rotation within a mixer housing 184. In the present example, the mixing mechanism 72 is a twin-shaft mixer including a pair of internal paddle augers 186, but other types of mixing mechanisms such as twin-shaft ribbon augers may be used, as long as they are capable of the shear mixing ability needed for the batch process, and their profile does not cause the plant to exceed the maximum footprint allowed for road travel. The shafts of the twin augers 186 are supported in the mixer housing 184 by end bearings 188 and coupled to gear box 190 of a hydraulic motor. Each of the twin augers 186 conveys material toward a distal opening in the mixer housing 184, which is covered by a mixer gate 192 that is coupled to a hydraulic gate ram 194.

The length L of the mixer 72 is substantially longer than a conventional mixer that would be used for a plant of similar capacity. For instance, a mixer in a plant designed according to the present disclosure may have a length L of approximately 21 feet for a discharge capacity of 3 cubic yards, whereas the length of commercially available mixers for this capacity is typically around 12 feet. At the same time, the internal bore diameter of the mixer 72 is substantially less than the internal bore diameter of a conventional mixer. For instance, for a discharge capacity of 3 cubic yards, mixer 72 may have an internal bore diameter of about 22 inches, where a conventional mixer for this capacity typically has an inner bore diameter of 4 to 5 feet. The uniquely low bore diameter to length ratio of the mixer 72 allows the mixer to be operated at maximum speeds in the range of about 30 to 40 rpm or higher, in contrast to the maximum speeds of 14 to 27 rpm for conventional mixers. Thus, the mixer 72 may operate at a high speed of about 32 rpm, or even up to 40 rpm or greater, to maximize shear mixing and to complete the mixing and blending of the materials in a very short time, such as 30 seconds or less. The mixer 52 may also be operated at slower speeds to control the discharge rate exiting through the mixer discharge gates 192.

The mixing mechanism 182 is bi-directional. That is, the augers 186 may be rotated in one direction to cause materials in the mixer to move toward the mixer discharge gates 192, or in the opposite direction to cause materials at the discharge end of the mixer to move toward the center of the mixer. In central and transit mixing operations, for instance, it may be desirable initially to run the mixing mechanism 182 in a first direction, causing aggregates dropped in through inlets 102 and 104 to move in a proximal direction so they can be thoroughly mixed with the powdery materials dropped in through inlet 116. Then, after the materials are mixed, the direction of the mixing mechanism 182 is reversed, causing the materials to be discharged through the discharge gates 192. It may also be desirable to run the mixing mechanism 182 in two directions for cleaning. As another example, the mixing mechanism 182 may need to change directions to prepare a mixture with or without certain features. As an example of preparing a mixture without undesirable features, the mixing mechanism 182 may be used to reduce or eliminate balling (e.g., cement balling), pockets (e.g., aggregate pockets), deficiencies (e.g., paste deficiencies) or any other features deemed undesirable in a particular mixture.

Each mixer gate 192 is kept closed until the batch controller 80 determines that the contents are ready to be discharged, at which point, the corresponding gate ram 194 is actuated, causing the gate 192 to rotate approximately 90 degrees about a seal block, allowing concrete to be discharged. The discharged concrete drops into a chute 196, which directs it through a cylindrical tube 198 into the inlet 200 of discharge auger 78.

A pair of rearwardly extending flanges 202, 204 is provided at the bottom end of the discharge auger 78. Each flange 202, 204 includes a notch or aperture 206 that receives a pivot pin 208 projecting outwardly from cylindrical tube 198, allowing the discharge auger 78 to pivot about a horizontal axis. Each flange also includes a finger 210 that is received in a circumferentially extending groove 212 formed in the tube 198, allowing the discharge auger 78 to swivel about a vertical axis. Thus, the discharge auger can be moved from a transit position, minimizing the footprint of the mixing plant, to an operating position, in line with the concrete forms or other location where the mixed material is to be dispensed. Normally, the discharge auger 78 is locked in the transit position by a safety latch which is manually released when certain conditions are met. At this point, a user can manually operate a hydraulic control valve that actuates auger ram 214 to place the discharge auger 78 in the desired position. This position can be changed as needed during the discharge process.

Discharge mechanisms other than discharge auger 78 may also be used. For instance, materials may be transported away from the discharge end of the mixer using a conveyor, or fed directly into concrete pumps.

The mixer housing 184 includes granular material inlets 102, 104, and 116 for receiving granular materials from granular bins 44, 46, 48. It also includes a powdery material inlet 216 for receiving powdery materials from blending auger 106, a liquid inlet 218 for receiving liquids from liquid tanks 62, 66 and admixture inlets 220, 222 for receiving admixture from admixture tanks 68, 70.

Figure 8:
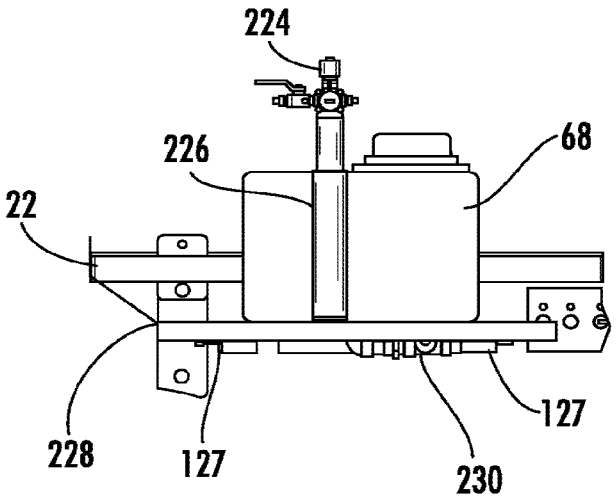
FIG. 8 is a right side isometric view of one of the admixture tanks of the mixing plant.

FIG. 8 shows an admixture assembly including a pair of load cells 127, admix air valve 224, admix tank strap 226, admix scale platform 228, dual admix tanks 68, 70 (only one visible in this view), and admix discharge valve 230. The admix tanks 68, 70 hold the admixture. Air valve 224 allows compressed air to move the admixture through the discharge valve 230. When not allowing compressed air to enter tanks 68, 70, the air valve 224 allows a path for the tanks 68, 70 to be vented to atmosphere. Tank strap 226 holds admix tanks 68, 70 to the frame 22 and supports the air valve 224.

Figure 9:
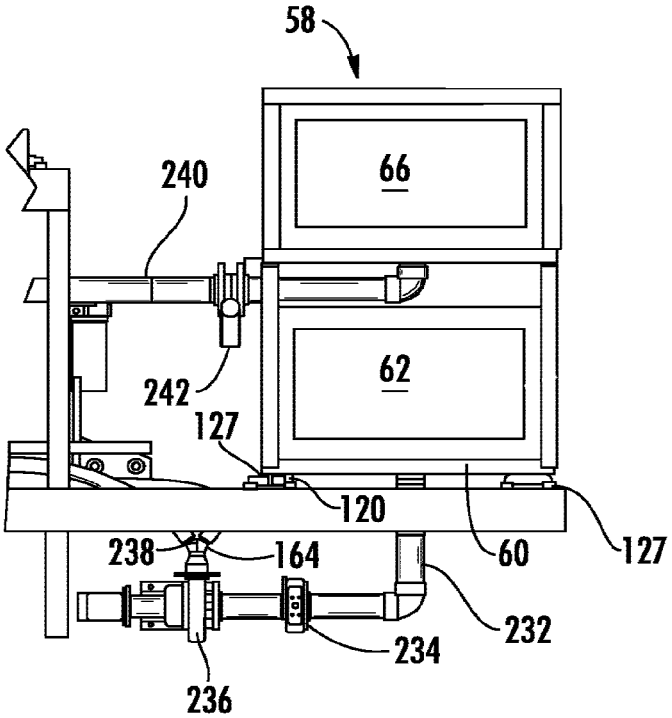
FIG. 9 is a left side elevation view of the water and activator tanks.

FIG. 9 shows rack 58 with liquid tanks 62 and 66. In this example, liquid tank 62 contains water, and liquid tank 66 contains cement activator. The same set of load cells 127 is used to measure the weight of both the water and the cement activator, with the controller 80 identifying which of the two liquids is being weighed at any given time. Water tank 62 is coupled to water discharge pipe 232, which is controlled by water discharge valve 234. A pump 236 in the water pipe 232 pressurizes the water as needed to clean the mixer 72 between batches. A splitter 238 above the pump 236 allows the water to be sent to the mixer 72 for central mixing, or directly to the discharge auger 78 or mixer truck for only transit mixing. Activator tank 66 is coupled to activator discharge pipe 240, which is controlled by activator discharge valve 242.

Figure 10:
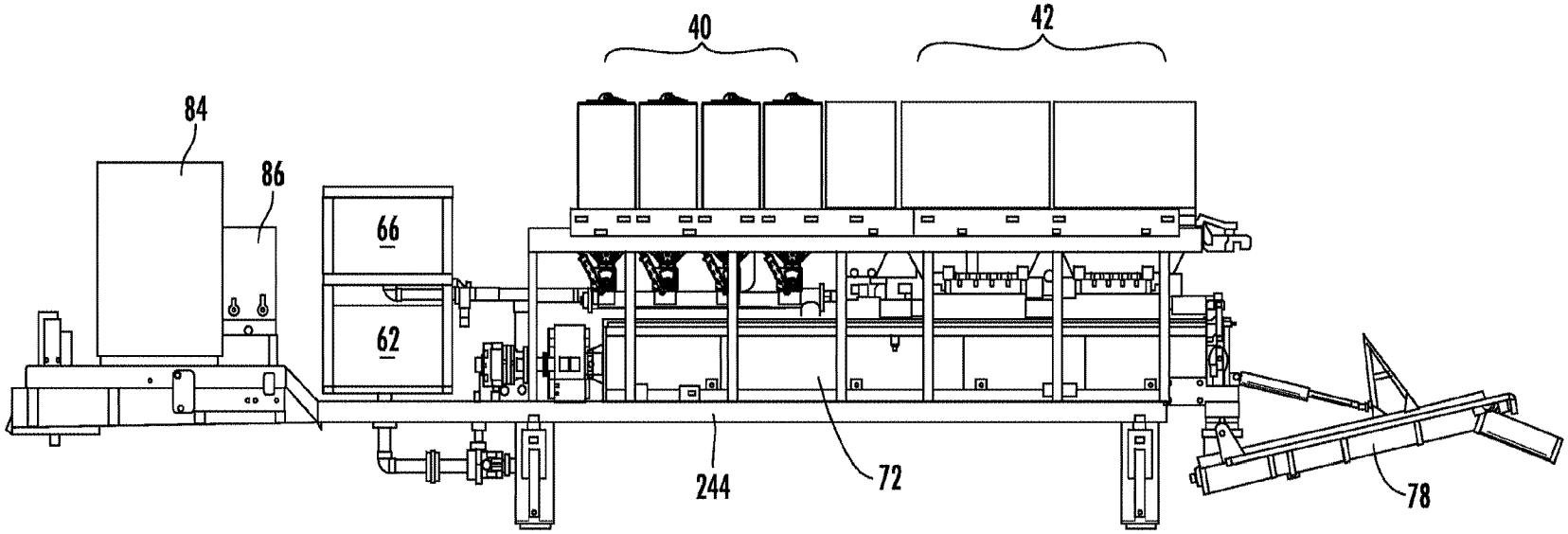
FIG. 10 is a right side elevation view of another embodiment of a mixing plant that does not have axles and wheels and can be loaded onto a flatbed to transport.

FIG. 10 shows an alternate embodiment of invention, wherein the mixing plant 20, which is otherwise identical or substantially similar to the embodiment of FIGS. 1-9 and 11, is mounted on an alternate frame 244 without wheels or trailer tongue. This embodiment may easily be loaded onto a flatbed truck, rather than towed to the job site.

The present disclosure includes concrete batching methods. In one embodiment, the batching method includes the following steps: loading raw materials into the bins of the mixing plant; pre-weighing the raw materials; mixing the raw materials in the mixer; and transporting the mobile plant to a job site.

The order of the steps may vary depending on the requirements of the construction projects. For instance, some projects may require that the materials are mixed before transporting the plant to the job site, while other projects may require or allow mixing after the plant is transported to the job site.

The manner of mixing the materials may also vary depending on job requirements. For instance, for jobs requiring central mixing, all of the dry materials in bins 44-56 plus at least one of the liquids in liquid tanks 62, 66 are conveyed to the mixer 72, which thoroughly mixes materials before moving them to the discharge auger, which then discharges the final product into concrete molds or loads them into a mixer truck for further transport. For jobs requiring transit mixing, the dry materials in are conveyed to the mixer 72, while the liquid materials are transported separately to the discharge end of the discharge auger or directly into a revolving drum truck or similar transport for mixing en route to the job. For jobs requiring shrink-mixing, water, admixtures, and all the dry ingredients except the coarse aggregates are mixed in the mixer 72. The coarse aggregates are dropped through the shrink-mixing inlet 102 at the distal end of the mixer 72 so they only pass through the mixer discharge gates, before they drop through chute 196 into the discharge auger 78, where they join the other pre mixed ingredients (Concrete Mortar).

For both central and transit mixing approaches, the mixing step includes moving the conveyor 100 under the coarse aggregate bin 44 in a proximal direction to bring the coarse aggregate to the central and transmit mixing inlet 104 located in an interior section of the mixer housing 184. This also includes rotating the mixer mechanism 182 in a first direction to move the coarse aggregate into the interior of the mixer, and then rotating the mixer mechanism 182 in a second direction to discharge materials into the discharge auger 78.

For a shrink-mixing approach, the mixing step includes moving the conveyor 100 under the coarse aggregate bin 44 in a distal direction to bring the coarse aggregate to the mixing inlet 102. This may only require rotating the mixer mechanism 182 in the second direction, since it is not necessary to move the coarse aggregate into the interior of the mixer.

In addition to the steps mentioned above, the method may include installation steps, control steps, and discharge steps. The installation steps may, for instance, include detaching the mixing plant 20 from the transport vehicle, releasing the hold-down mechanism 140, and leveling the mixing plant. The control steps may include starting the power source 82, selecting the mixing approach, and selecting one or more mixer speeds and directions. The discharge step may include positioning the discharge auger 78, opening the mixer gates 192, positioning the discharge auger 78, and discharging the materials. Additional steps may include replenishing the materials and moving the plant to the next job site. The steps of the above methods need not be executed in a particular order. In certain embodiments, only some and not all of the steps are executed.

While exemplary embodiments are described above, it is not intended that these embodiments describe all possible forms of the invention. Rather, the words used in the specification are words of description rather than limitation, and it is understood that various changes may be made without departing from the spirit and scope of the invention. For instance, the various bins and tanks may be loaded with mixing materials for construction projects requiring products other than concrete. Similarly, the mixer 72 can be a ribbon mixer, a paddle mixer, a single-shaft ribbon or paddle mixer, or a twin-shaft ribbon or paddle mixer. In some applications, the belt conveyors under the aggregate bins may be replaced with augers. The energy source can be electric or solar. Manual controls may be used rather than an electronic logic-based controller. Additionally, the features of various implementing embodiments may be combined to form further embodiments of the invention.

What is claimed is:

1. A construction plant comprising:

a first set of bins configured to contain and dispense granular materials, the first set of bins including a distalmost bin configured to contain and discharge coarse aggregate material;

a second set of bins configured to contain and dispense powdery materials;

a mixer configured to receive and mix materials discharged from the first and second sets of bins, the mixer comprising a mixer housing positioned below the first and second sets of bins, the mixer housing having a discharge opening disposed at a distal end;

a first conveying assembly configured to transport granular materials from the first set of bins to the mixer, the first conveying assembly including a two-way conveyor positioned below the distalmost bin and movable in a distal direction to transport coarse aggregate material from the distalmost bin to the distal end of the mixer and in a proximal direction to transport coarse aggregate material from the distalmost bin to an intermediate portion of the mixer;

a second conveying assembly configured to transport powdered materials from the second set of bins to the mixer; and a frame configured to serve as a base to support the first and second sets of bins, the mixer, and the first and second conveying assemblies and to keep the construction plant as a unit for convenient transportation.

2. The construction plant of claim 1, wherein the mixer comprises:

a horizontal shaft mixing mechanism mounted for rotation within the mixer housing.

3. The construction plant of claim 2, wherein:

each of the bins in the first set includes a granular material outlet;

the mixer housing includes a plurality of granular material inlets, wherein each of the granular material inlets corresponds to a different one of the bins in the first set; and the first conveying assembly includes a plurality of conveyors located between the first set of bins and the mixer, wherein each conveyor is associated with a different one of the bins and includes a first end positioned below the granular material outlet of its associated bin and a second end positioned above the granular material inlet corresponding with the associated bin.

4. The construction plant of claim 2, wherein:

the mixer housing includes a powdered material inlet; and the second conveying assembly comprises a blending auger configured to transport powdered materials from the second set of bins to the powdered material inlet in the mixer housing.

5. The construction plant of claim 4, wherein:

each of the bins in the second set of bins is a low-profile bin having a substantially flat bottom; and the second conveying assembly further comprises an internal auger positioned within the flat bottom of each of the bins in the second set.

6. The construction plant of claim 1, further comprising a discharge gate coupled to the discharge opening.

7. The construction plant of claim 1, wherein the mixer is a twin shaft mixer configured to rotate bi-directionally.

8. The construction plant of claim 1, further comprising a weighing scale coupled to each of the bins and configured to measure the weight of the material contained in the bin.

9. The construction plant of claim 1, further comprising:

a first tank configured to contain a first liquid;

a second tank configured to contain a second liquid and supported above the first tank; and a weigh scale positioned below the first tank and configured to measure the weight of the first and second liquids.

10. The construction plant of claim 9, wherein:

the first tank contains water;

the second tank contains cement activator; and further comprising at least one additional tank containing a concrete admixture, and a weigh scale positioned below the additional tank and configured to measure the weight of the concrete admixture.

11. A construction method comprising:

providing a mobile plant including a first set of bins configured to contain and dispense granular materials, the first set of bins including a distalmost bin configured to contain and discharge coarse aggregate material;

a second set of bins configured to contain and dispense powdery materials;

a mixer configured to receive and mix materials discharged from the first and second sets of bins, the mixer comprising a mixer housing positioned below the first and second sets of bins, the mixer housing having a discharge opening disposed at a distal end;

a first conveying assembly configured to transport granular materials from the first set of bins to the mixer, the first conveying assembly including a two-way conveyor positioned below the distalmost bin and movable in a distal direction to transport coarse aggregate material from the distalmost bin to the distal end of the mixer and in a proximal direction to transport coarse aggregate material from the distalmost bin to the an intermediate portion of the mixer;

a second conveying assembly configured to transport powdered materials from the second set of bins to the mixer;

a tank configured to contain a liquid; and a frame configured to serve as a base to support the first and second sets of bins, the mixer, the tank, and the first and second conveying assemblies and to keep the construction plant as a unit for convenient transportation;

pre-weighing the granular and powdery materials and the liquid;

mixing the granular and powdery materials in the mixer; and transporting the mobile plant to a job site.

12. A construction method according to claim 11, wherein:

the mobile plant includes wheels; and transporting the mobile plant to the job site comprises towing the mobile plant to the job site.

13. A construction method according to claim 11, wherein transporting the mobile plant to the job site comprises mounting the mobile plant on a flatbed truck.

14. A construction method according to claim 11, wherein mixing the granular and powdery materials comprises mixing the granular and powdery materials at a radial speed of more than 30 rpm.

15. A construction method according to claim 11, wherein mixing the granular and powdery materials comprises mixing the granular and powdery material at a radial speed of at least 40 rpm.

16. A construction plant comprising:

a first set of bins configured to contain and dispense granular materials;

a second set of bins configured to contain and dispense powdery materials;

at least one tank configured to contain a liquid material;

at least one load cell associated with each of the bins and the tank, wherein said load cell is configured and positioned to weigh the material contained within the associated bin or tank;

a mixer configured to receive and mix materials discharged from the first and second sets of bins, the mixer being disposed directly below the first set of bins and the second set of bins;

a first conveying assembly configured to transport granular materials from the first set of bins to the mixer;

a second conveying assembly configured to transport powdered materials from the second set of bins to the mixer;

a controller electronically coupled to each of the load cells, the first and second conveying assemblies, and the mixer, and configured to operate the first and second conveying assemblies and the mixer in response to information received from the load cells; and a frame configured to serve as a base to support the first and second sets of bins, the mixer, and the first and second conveying assemblies and to keep the construction plant as a unit for convenient transportation.

17. A construction plant according to claim 16, wherein:

each of the bins in the first set includes a granular material outlet;

each of the bins in the second set includes a powdery material outlet;

the mixer includes a mixer housing including a plurality of granular material inlets, wherein each of the granular material inlets corresponds to a different one of the bins in the first set, and a single powdered material inlet, and a horizontal shaft mixing mechanism mounted for rotation within the mixer housing;

the first conveying assembly includes a plurality of conveyors disposed directly below the first set of bins between the first set of bins and the mixer, wherein each conveyor is associated with a different one of the bins of the first set of bins and includes a first end positioned below the granular material outlet of its associated bin and a second end positioned above the granular material inlet corresponding with the associated bin; and the second conveying assembly comprises a blending auger configured to transport powdered materials from the second set of bins to the powdered material inlet in the mixer housing.

18. The construction plant of claim 17, wherein:

the mixer housing has a distal end including a discharge opening;

the construction plant further comprises a discharge auger coupled to the distal end of the of the mixer housing;

the first set of bins includes a distalmost bin configured to contain and discharge coarse aggregate material; and the first conveying assembly includes a two-way conveyor positioned below the distalmost bin and movable in a distal direction to transport coarse aggregate material from the distalmost bin to the discharge auger and in a proximal direction to transport coarse aggregate material from the distalmost bin to the mixer.

* * * * *